US005861854A

United States Patent [19]

Kawahata et al.

[11] Patent Number: 5,861,854

[45] Date of Patent: Jan. 19, 1999

[54] SURFACE-MOUNT ANTENNA AND A COMMUNICATION APPARATUS USING THE SAME

[75] Inventors: Kazunari Kawahata; Ken Okada, both of Kyoto, Japan

[73] Assignee: Murata Mfg. Co. Ltd., Kyoto, Japan

[21] Appl. No.: 874,132

[22] Filed: Jun. 13, 1997

[30] Foreign Application Priority Data

Jun. 19, 1996 [JP] Japan ..... 8-158153

[51] Int. Cl.[6] ..... H01Q 1/24; H01Q 1/38

[52] U.S. Cl. ..... 343/702; 343/702; 343/700 MS; 343/895

[58] Field of Search ..... 343/700 MS, 702, 343/895

[56] References Cited

U.S. PATENT DOCUMENTS 5,541,616 7/1996 Kawahata et al. ..... 343/702
5,581,262 12/1996 Kawahata et al. ..... 343/700 MS
5,588,198 12/1996 Kawahata et al. ..... 343/702
5,627,551 5/1997 Tsuru et al. ..... 343/702
5,696,517 12/1997 Kawahata et al. ..... 343/702
5,760,746 6/1998 Kawahata ..... 343/702

*Primary Examiner*—Frank G. Font
*Assistant Examiner*—Roy M. Punnoose
*Attorney, Agent, or Firm*—Ostrolenk, Faber Gerb & Soffen, LLP

[57] ABSTRACT

A surface-mount antenna includes a radiation electrode formed on one or more surfaces of a rectangular parallelopiped base member comprising a dielectric or a magnetic substance so as to have one end as an open end and another end as a first ground electrode, a feeding electrode formed on the surface or surfaces, and a second ground electrode formed in proximity to the open end of said radiation electrode.

39 Claims, 4 Drawing Sheets

SURFACE-MOUNT ANTENNA AND A COMMUNICATION APPARATUS USING THE SAME

BACKGROUND OF THE INVENTION

1. Field of the Invention

The present invention relates to surface-mount antennas used for mobile communication equipment and so forth, and in particular to communication apparatus using the surface-mount antennas.

2. Description of the Related Art

A λ/4 patch antenna as a conventional surface-mount antenna is shown in FIG. 7. A patch antenna 70 has a ground electrode 72 on one main surface of a board base member 71 comprising a dielectric, and a radiation electrode 73 on another main surface. The radiation electrode 73 is connected at one side to the ground electrode 72 on the main surface by a plurality of short pins 74. In addition, a feeding pin 75 is provided in the vicinity of the center of the radiation electrode 73.

In the patch antenna 70 having the above structure, when a high frequency signal is inputted to the radiation electrode 73 from the feeding pin 75, the radiation electrode 73 resonates as a resonator λ/4 long which has a grounded end at the short pins 74 and an open end at the opposed end, and functions as an antenna by radiating part of its resonant power into space. In addition, impedance matching is performed by providing the feeding pin 75 at the appropriate position between the grounded end and the open end.

However, according to the above patch antenna 70, the feeding pin 75 is difficult to provide since the feeding pin 75 is positioned in the vicinity of the center of the radiation electrode 73. In addition, reducing the size of the patch antenna 70 causes difficulty in matching due to the feeding pin 75 being close to the short pins 74, the inductance of the feeding pin 75, and changes in resonant frequency.

SUMMARY OF THE INVENTION

Accordingly, it is an object of the present invention to provide a surface-mount antenna in which excitation can occur without contact by using a capacitor, and matching can be performed even if the antenna size is reduced and which can be easily mounted on a surface by an input end formed on a side of a base member.

It is another object of the present invention to provide a communication apparatus to which the above antenna is mounted.

To this end, according to an aspect of the present invention, the foregoing objects have been achieved through provision of a surface-mount antenna in which a radiation electrode is formed on one or more surfaces of a rectangular parallelopiped base member comprising a dielectric or a magnetic substance so as to have one end as an open end and another end as a first ground electrode, and a feeding electrode is formed on the surface or surfaces, wherein a second ground electrode is formed in proximity to the open end of the radiation electrode.

Preferably, the formed radiation electrode is bent so as be roughly L-shaped, roughly U-shaped or meander-shaped.

The open end of the radiation electrode and one end of the second ground electrode may be formed on the same surface of the base member.

The open end of the radiation electrode and one end of the second ground electrode may be formed on the two adjacent surfaces of the base member, respectively.

The first ground electrode and the second ground electrode may be formed to be connected.

According to another aspect of the present invention, the foregoing objects have been achieved through provision of a communication apparatus with a surface-mount antenna mounted on a circuit board, in which surface-mount antenna a radiation electrode is formed on one or more surfaces of a rectangular parallelopiped base member comprising a dielectric or a magnetic substance so as to have one end as an open end and another end as a first ground electrode, a feeding electrode is formed on the one or more surfaces, and a second ground electrode is formed in proximity to the open end of the radiation electrode, in which communication apparatus the top surface of the circuit board where the surface-mount antenna is mounted and the bottom surface are provided with board-exposed portions, and the surface-mount antenna is mounted on the circuit board-exposed portion on the top surface of the circuit board.

According to a surface-mount antenna of the present invention, by forming an open end of a radiation electrode and a feeding electrode with a distance provided therebetween, capacitance coupling enables non-contact excitation, and matching can be easily performed by adjusting the detached distance. In addition, by forming a second ground electrode, the capacitance between the open end of the radiation electrode and the ground can be increased, which reduces the inductance of the radiation electrode in the case of the same frequency. As a result, the length of the radiation electrode can be shortened, which enables reduction of the antenna size. Moreover, the capacitance between the open end of the radiation electrode and the ground is stabilized. Thus, adjustment of a frequency and so forth can be easily performed.

According to a communication apparatus of the present invention, no change occurs in radiation resistance or the capacitance between adjacent electrodes when a surface-mounted antenna is mounted. Thus, operation as an antenna is realized.

Other features and advantages of the present invention will become apparent from the following description of the invention which refers to the accompanying drawings.

DETAILED DESCRIPTION OF EMBODIMENTS OF THE INVENTION

A surface-mount antenna according to an embodiment of the present invention will be described below based on the attached drawings.

Figure 1:
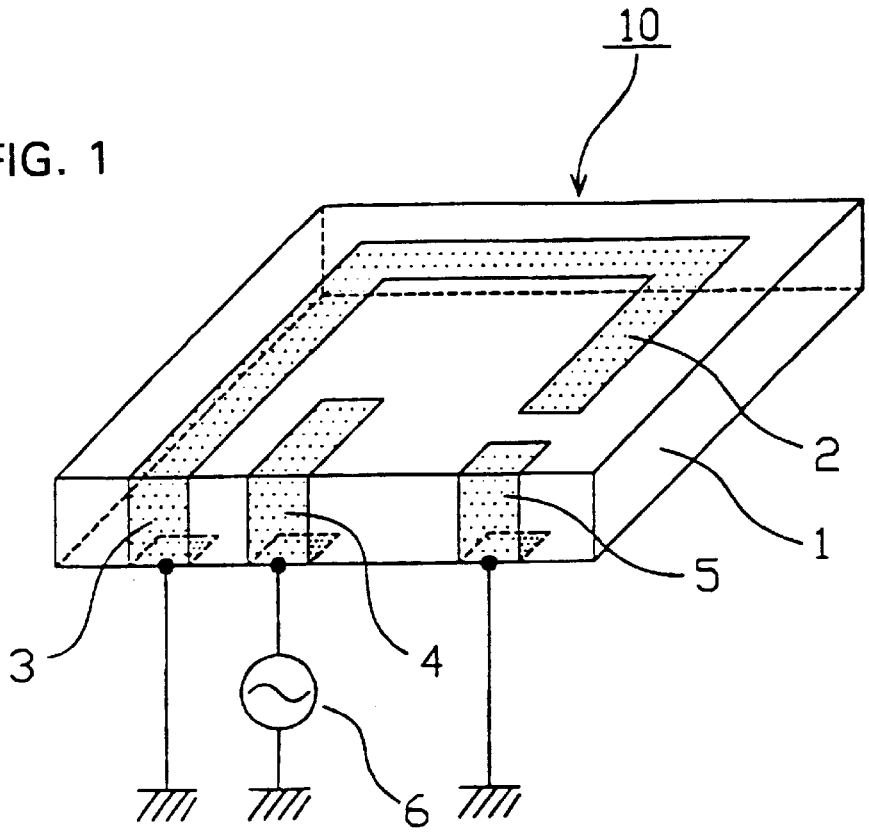
FIG. 1 is a perspective view illustrating a surface-mount antenna according to an embodiment of the present invention.

Referring to FIG. 1, a surface-mount antenna 10 includes a rectangular parallelopiped base member 1 comprising a dielectric like resin and a U-shaped radiation electrode 2, a first ground electrode 3, a feeding electrode 4 and a second ground electrode 5 which are formed thereon. The radiation electrode 2 is formed on one main surface of the base member 1 with one end used as an open end, and another end connected to the first ground electrode 3 continuously formed over a side to the other main surface of the base member 1. The feeding electrode 4 is continuously formed from the main surface to the side and to the other main surface of the base member 1 in proximity to the first ground electrode 3. The second ground electrode 5 is continuously formed from the main surface to the side and to the other main surface of the base member 1 with one end being in proximity to the open end of the radiation electrode 2. A high frequency signal source 6 is connected to the feeding electrode 4.

Figure 2:
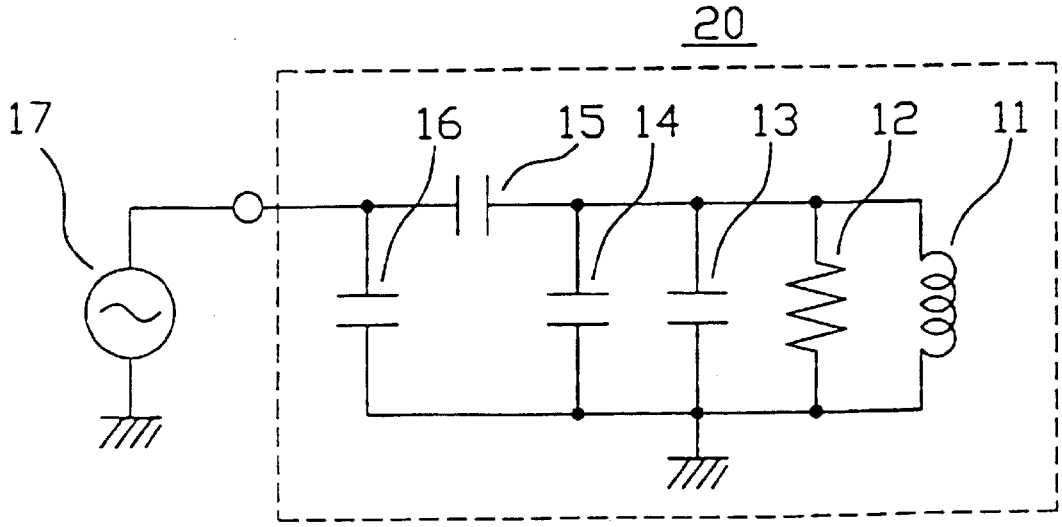
FIG. 2 is a circuit diagram showing an equivalent circuit of the surface-mount antenna shown in FIG. 1.

An electrical equivalent circuit of this embodiment is shown in FIG. 2. The equivalent circuit 20 of the surface-mount antenna 10 includes an inductor 11, a resistor 12, and capacitors 13, 14, 15 and 16. The inductor 11, the resistor 12, and the capacitors 13 and 14 are connected in parallel, with their ends being grounded. The other ends are grounded with the capacitors 15 and 16 connected in parallel. In addition, a high frequency signal source 18 is connected to a point at which the capacitors 15 and 16 are connected.

Referring to the relationship with the structure in FIG. 1, the inductor 11 represents the self-inductance of the radiation electrode 2; the capacitor 13 represents the capacitance between the open end of the radiation electrode 2 and the first ground electrode 3; the capacitor 14 represents the capacitance between the open end of the radiation electrode 2 and the second ground electrode 5; the capacitor 15 represents the capacitance between the open end of the radiation electrode 3 and the feeding electrode 4; and the capacitor 16 represents the capacitance between the feeding electrode 4 and the first and second ground electrodes 3 and 5. In addition, the resistor 12 represents the radiation resistance of the surface-mount antenna 10.

Using the equivalent circuit in FIG. 2, operation of the surface-mount antenna 10 will be described below. The resonant circuit 10 chiefly includes the inductor 11, the resistor 12, and the capacitors 13 and 14. The capacitor 14 has a capacitance larger than that of the capacitor 13, and is inserted in parallel so as to increase and stabilize the capacitance component of the resonant circuit.

When a signal is inputted to the resonant circuit from the high frequency signal source 17 via the capacitor 15, the energy of the input signal resonates in the resonant circuit, and part of the energy is radiated to space to enable functioning of the antenna. The radiated energy is determined as energy consumed by the resistor 12 in the resonant circuit.

In addition, the capacitor 15 functions as an entrance for supplying the energy to the resonant circuit, and combines with the capacitor 16 to function simultaneously so as to perform matching with an external circuit.

Figure 3:
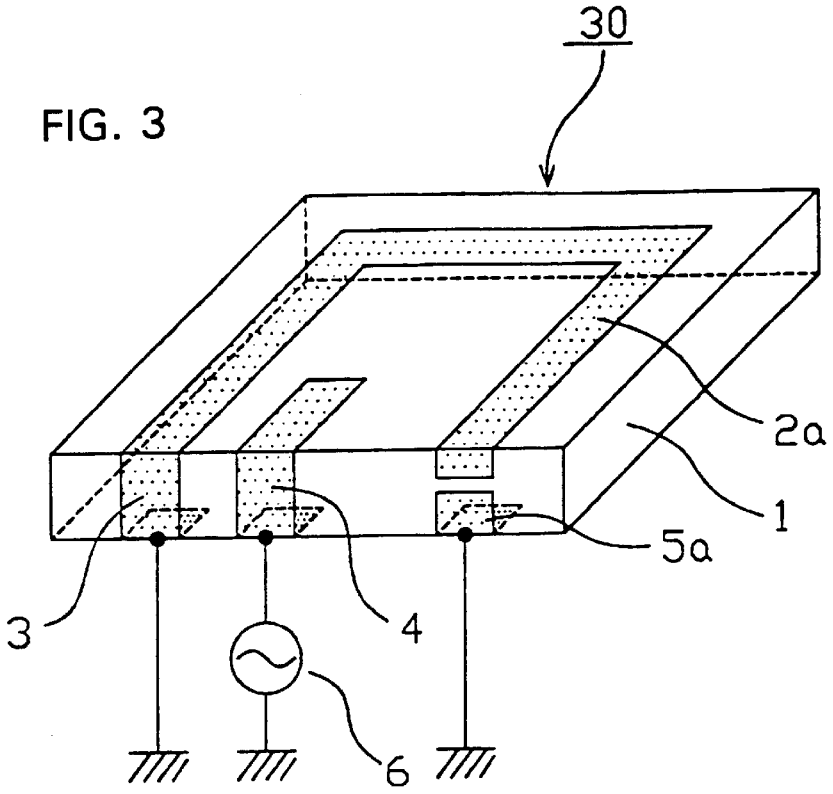
FIG. 3 is a perspective view illustrating a surface-mount antenna according to another embodiment of the present invention.

A surface-mount antenna according to another embodiment of the present invention is shown in FIG. 3. An open end of a radiation electrode 2*a* of a surface-mount antenna 30 is formed on one side of a base member 1, and one end (open end) of a second ground electrode 5*a* is formed on the same side. Other arrangements are identical to the embodiment shown in FIG. 1. The equivalent circuit of this embodiment is identical to that of FIG. 2. Identical portions are denoted by identical reference numerals, and a description of the equivalent circuit and operation will be omitted.

Figure 4:
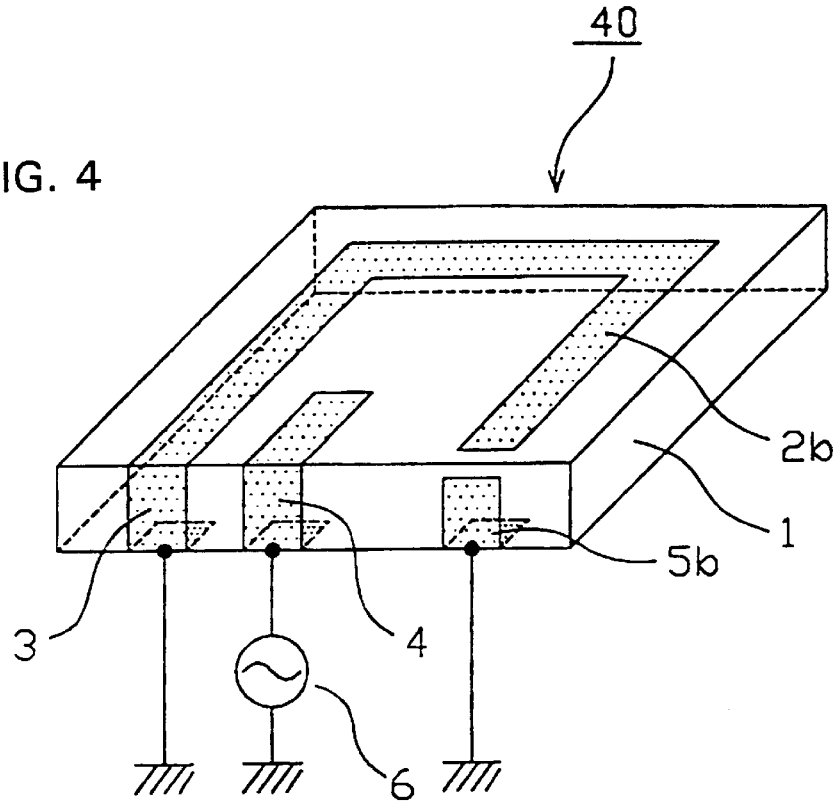
FIG. 4 is a perspective view illustrating a surface-mount antenna according to a further embodiment of the present invention.

A surface-mount antenna according to a further embodiment of the present invention is shown in FIG. 4. An open end of a radiation electrode 2*b* of a surface-mount antenna 40 is formed on one main surface of a base member 1, and one end (open end) of a second ground electrode 5*b* is formed on one side perpendicular to the main surface of the base member 1. Other arrangements are identical to the embodiment shown in FIG. 1. The equivalent circuit of this embodiment is similar to that of FIG. 2. Identical portions are denoted by identical reference numerals, and a description of the equivalent circuit and operation will be omitted.

Figure 5:
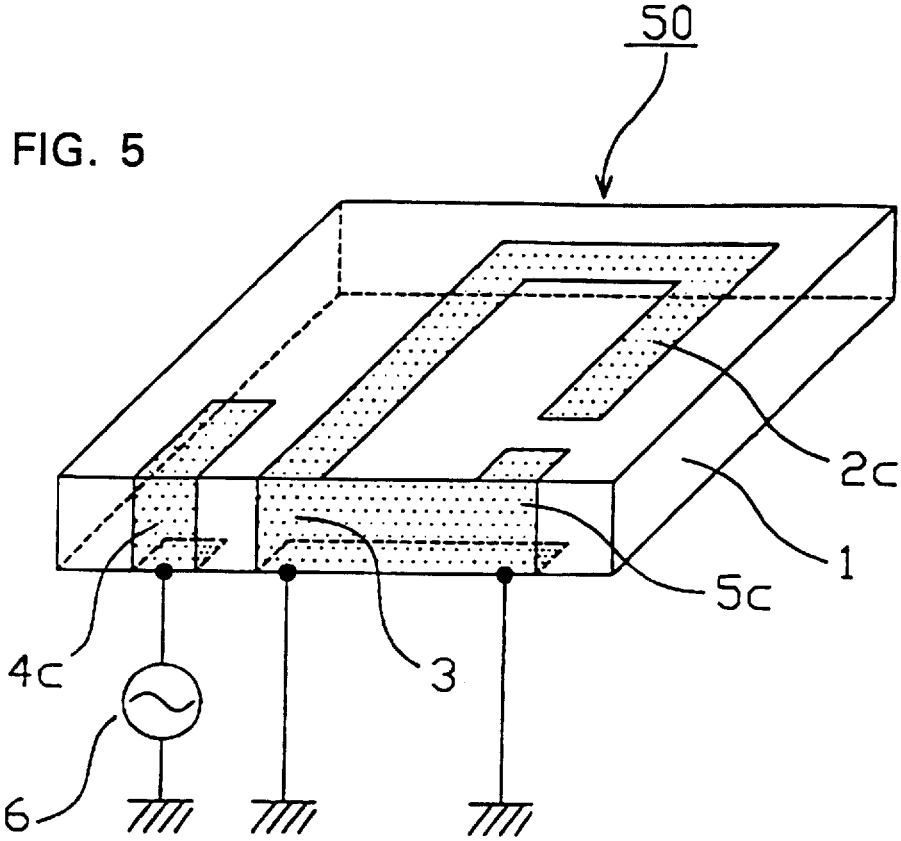
FIG. 5 is a perspective view illustrating a surface-mount antenna according to a still further embodiment of the present invention.

A surface-mount antenna according to a still further embodiment of the present invention is shown in FIG. 5. A second ground electrode 5*c* is formed so as to connect with a first ground electrode 3, and a feeding electrode 4*c* is formed on one main surface of a base member 1 so as to be adjacent to the first ground electrode 3 and away from an open end of a radiation electrode 2*c*. Other arrangements are identical to the embodiment shown in FIG. 1. The equivalent circuit of this embodiment is similar to that of FIG. 2. Identical portions are denoted by identical reference numerals, and a description of the equivalent circuit and operation will be omitted.

A U-shaped radiation electrode is employed in the above embodiments. The radiation electrode may have another shape such as an L shape or a meander, and a function equivalent to that of the U-shaped radiation electrode can be obtained. Although a dielectric is used as the base member, the base member may comprise a magnetic substance.

Figure 6:
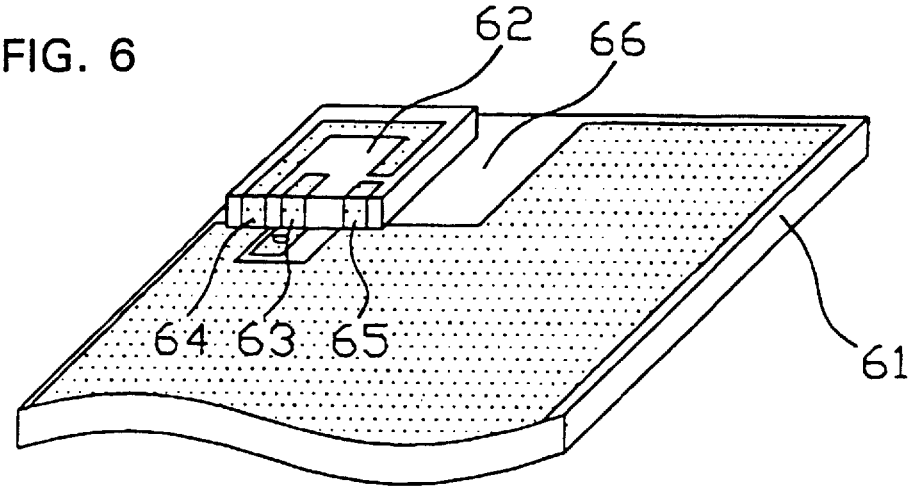
FIG. 6 is a perspective view illustrating an embodiment in which a surface-mount antenna of the present invention is mounted on a printed circuit board.
Figure 7:
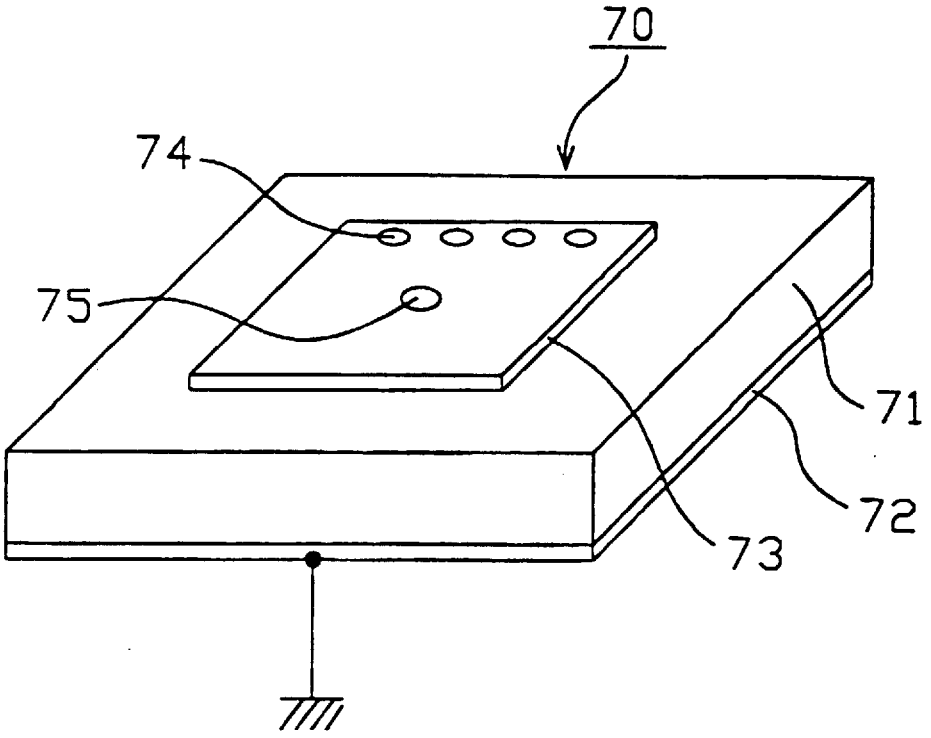
FIG. 7 is a perspective view illustrating a conventional surface-mount antenna.

An embodiment in which a surface-mount antenna of the present invention is mounted on a communication apparatus is shown in FIG. 6. A surface-mount antenna 62 is mounted on a printed board 61 by fixing three points: a feeding electrode 63, and ground electrodes 64 and 65 with, for example, solder. No electrodes are formed on an area of the printed board 61 where the surface-mount antenna 62 is mounted or its periphery (including the bottom surface opposed to the antenna-mounted surface of the printed circuit board 61). A circuit board-exposed portion 66 where the board 61 is exposed is formed, and the surface-mount antenna is mounted on the circuit board-exposed portion 66. This enables operation as an antenna without radiation resistance change or capacitance change between adjacent electrodes occurring when the surface-mount antenna is mounted.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A surface-mount antenna comprising:

a rectangular parallelopiped base member comprising at least one of a dielectric substrate and a magnetic substrate;

a radiation electrode disposed on at least one surface of the base member, the radiation electrode having a first end comprising an open end and a second end comprising a first ground electrode;

a feeding electrode being disposed on at least one surface of the base member; and a second ground electrode being disposed in proximity to the open end of said radiation electrode.

2. The surface-mount antenna of claim 1, wherein said radiation electrode is at least one of roughly L-shaped, roughly U-shaped and meander-shaped.

3. The surface-mount antenna of claim 1, wherein the open end of said radiation electrode and one end of said second ground electrode are disposed on the same surface of said base member.

4. The surface-mount antenna of claim 2, wherein the open end of said radiation electrode and one end of said second ground electrode are disposed on the same surface of said base member.

5. The surface-mount antenna of claim 1, wherein the open end of said radiation electrode and one end of said second ground electrode are disposed on two adjacent surfaces of said base member, respectively.

6. The surface-mount antenna of claim 2, wherein the open end of said radiation electrode and one end of said second ground electrode are disposed on two adjacent surfaces of said base member, respectively.

7. The surface-mount antenna of claim 1, wherein said first ground electrode and said second ground electrode are connected.

8. The surface-mount antenna of claim 2, wherein said first ground electrode and said second ground electrode are connected.

9. The surface-mount antenna of claim 3, wherein said first ground electrode and said second ground electrode are connected.

10. The surface-mount antenna of claim 5, wherein said first ground electrode and said second ground electrode are connected.

11. The surface-mount antenna of claim 1, wherein the base member has two opposed main surfaces and four side surfaces connecting the main surfaces and further wherein the radiation electrode is disposed on a first main surface, the first ground electrode is disposed on a first side surface and connected to the radiation electrode, the feeding electrode is disposed on the first side surface and extends onto the first main surface and the second ground electrode is disposed on the first side surface and extends onto the first main surface adjacent the open end of the radiation electrode.

12. The surface-mount antenna of claim 1, wherein the base member has two opposed main surfaces and four side surfaces connecting the main surfaces and further wherein the radiation electrode is disposed on a first main surface, the first ground electrode is disposed on a first side surface and connected to the radiation electrode, the feeding electrode is disposed on the first side surface and extends onto the first main surface and the second ground electrode is disposed on the first side surface and the radiation electrode extends onto the first side surface so that its open end is adjacent the second ground electrode.

13. The surface-mount antenna of claim 1, wherein the base member has two opposed main surfaces and four side surfaces connecting the main surfaces and further wherein the radiation electrode is disposed on a first main surface, the first ground electrode is disposed on a first side surface and connected to the radiation electrode, the feeding electrode is disposed on the first side surface and extends onto the first main surface and the second ground electrode is disposed on the first side surface and extends on the first side surface to a position such that it is disposed adjacent the open end on the first main surface of the radiation electrode.

14. The surface-mount antenna of claim 1, wherein the base member has two opposed main surfaces and four side surfaces connecting the main surfaces and further wherein the radiation electrode is disposed on a first main surface, the first ground electrode is disposed on a first side surface and connected to the radiation electrode, the feeding electrode is disposed on the first side surface and extends onto the first main surface and the second ground electrode is disposed on the first side surface and extends onto the first main surface adjacent the open end of the radiation electrode, the first and second ground electrodes being connected together on the first side surface, the feeding electrode being disposed to one side of said first and second ground electrodes.

15. The surface-mount antenna of claim 11, wherein the feeding electrode is disposed between the first and second ground electrodes.

16. The surface-mount antenna of claim 12, wherein the feeding electrode is disposed between the first and second ground electrodes.

17. The surface-mount antenna of claim 13, wherein the feeding electrode is disposed between the first and second ground electrodes.

18. The surface-mount antenna of claim 11, wherein the first and second ground electrodes and the feeding electrode extend onto the second main surface.

19. The surface-mount antenna of claim 12, wherein the first and second ground electrodes and the feeding electrode extend onto the second main surface.

20. The surface-mount antenna of claim 13, wherein the first and second ground electrodes and the feeding electrode extend onto the second main surface.

21. The surface-mount antenna of claim 14, wherein the first and second ground electrodes and the feeding electrode extend onto the second main surface.

22. A communication apparatus having a surface-mount antenna mounted on a circuit board, the surface-mount antenna comprising a rectangular parallelopiped base member comprising at least one of a dielectric substrate and a magnetic substrate, a radiation electrode disposed on at least one surface of the base member, the radiation electrode having a first end comprising an open end and a second end comprising a first ground electrode, a feeding electrode being disposed on at least one surface of the base member and a second ground electrode being disposed in proximity to the open end of said radiation electrode, a top surface of said circuit board of the communication apparatus having said surface-mount antenna mounted thereon, the top surface and a bottom surface of the circuit board being provided with board-exposed portions which do not have printed circuit patterns, said surface-mount antenna being mounted on said circuit board-exposed portion on the top surface of said circuit board.

23. The communication apparatus of claim 22, wherein said radiation electrode is at least one of roughly L-shaped, roughly U-shaped and meander-shaped.

24. The communication apparatus of claim 22, wherein the open end of said radiation electrode and one end of said second ground electrode are disposed on the same surface of said base member.

25. The communication apparatus of claim 23, wherein the open end of said radiation electrode and one end of said second ground electrode are disposed on the same surface of said base member.

26. The communication apparatus of claim 22, wherein the open end of said radiation electrode and one end of said second ground electrode are disposed on two adjacent surfaces of said base member, respectively.

27. The communication apparatus of claim 23, wherein the open end of said radiation electrode and one end of said second ground electrode are disposed on two adjacent surfaces of said base member, respectively.

28. The communication apparatus of claim 22, wherein said first ground electrode and said second ground electrode are connected.

29. The communication apparatus of claim 23, wherein said first ground electrode and said second ground electrode are connected.

30. The communication apparatus of claim 24, wherein said first ground electrode and said second ground electrode are connected.

31. The communication apparatus of claim 26, wherein said first ground electrode and said second ground electrode are connected.

32. The communication apparatus of claim 22, wherein the surface-mount antenna is mounted on the circuit board by soldering said first and second ground electrodes and said feeding electrode to respective terminals on the circuit board.

33. A surface-mount antenna comprising:

a rectangular parallelopiped base member comprising at least one of a dielectric substrate and a magnetic substrate;

a radiation electrode disposed on at least one surface of the base member, the radiation electrode having a first end comprising an open end and a second end comprising a first ground electrode;

a feeding electrode disposed on at least one surface of the base member such that a first capacitance is formed between the feeding electrode and the open end of the radiation electrode; and a second ground electrode being disposed on at least one surface of the base member;

a second capacitance being formed between the feeding electrode and the first ground electrode and the feeding electrode and the second ground electrode.

34. The surface-mount antenna of claim 33, wherein said radiation electrode is at least one of roughly L-shaped, roughly U-shaped and meander-shaped.

35. The surface-mount antenna of claim 33, wherein the open end of said radiation electrode and one end of said second ground electrode are disposed on the same surface of said base member.

36. The surface-mount antenna of claim 33, wherein the open end of said radiation electrode and one end of said second ground electrode are disposed on two adjacent surfaces of said base member, respectively.

37. The surface-mount antenna of claim 33, wherein said first ground electrode and said second ground electrode are connected.

38. The surface-mount antenna of claim 33, wherein there is a third capacitance between the open end of the radiation electrode and the first ground electrode.

39. The surface-mount antenna of claim 38, wherein there is a fourth capacitance between the open end of the radiation electrode and the second ground electrode.

* * * * *